US008824936B2

(12) United States Patent
Arakawa

(10) Patent No.: US 8,824,936 B2
(45) Date of Patent: Sep. 2, 2014

(54) IMAGE FORMING METHOD USING AN EXTERNAL ADDITIVE OF INORGANIC FINE PARTICLES THAT HAVE BEEN SUBJECTED TO SURFACE TREATMENT WITH A TIN-CONTAINING COMPOUND AND AN ANTIMONY-CONTAINING COMPOUND

(75) Inventor: Takeshi Arakawa, Osaka (JP)

(73) Assignee: Kyocera Document Solutions Inc. (JP)

( * ) Notice: Subject to any disclaimer, the term of this patent is extended or adjusted under 35 U.S.C. 154(b) by 287 days.

(21) Appl. No.: 13/235,545

(22) Filed: Sep. 19, 2011

(65) Prior Publication Data

US 2012/0070197 A1 Mar. 22, 2012

(30) Foreign Application Priority Data

Sep. 22, 2010 (JP) ..... 2010-211513

(51) Int. Cl.
*G03G 15/09* (2006.01)
*G03G 15/08* (2006.01)
*G03G 21/00* (2006.01)

(52) U.S. Cl.
CPC ..... *G03G 15/0818* (2013.01); *G03G 21/0005* (2013.01)
USPC ..... 399/267; 399/286; 399/343

(58) Field of Classification Search
USPC ..... 399/267, 343
See application file for complete search history.

(56) References Cited

U.S. PATENT DOCUMENTS 5,464,722 A * 11/1995 Tomiyama et al. ..... 430/137.21
2005/0065006 A1 3/2005 Tsubota et al.
2005/0201778 A1* 9/2005 Takada et al. ..... 399/159
2006/0191139 A1* 8/2006 Hayashi et al. ..... 29/895.32
2007/0248391 A1* 10/2007 Yokokawa et al. ..... 399/400
2008/0124642 A1* 5/2008 Nakayama et al. ..... 430/108.6
2008/0233510 A1* 9/2008 Nozaki et al. ..... 430/111.4
2008/0292983 A1* 11/2008 Mizuhata et al. ..... 430/108.6
2009/0154962 A1* 6/2009 Kotera et al. ..... 399/276
2010/0226666 A1* 9/2010 Nakatsuhara ..... 399/43
2010/0247187 A1* 9/2010 Maeda et al. ..... 399/346
2011/0058831 A1* 3/2011 Usami et al. ..... 399/46

FOREIGN PATENT DOCUMENTS

JP 5-46008 2/1993
JP 2003-35992 2/2003

* cited by examiner

*Primary Examiner* — David Bolduc

(74) *Attorney, Agent, or Firm* — Gerald E. Hespos; Michael J. Porco; Matthew T. Hespos

(57) ABSTRACT

The image forming apparatus is an image forming apparatus including an image bearing member, a developing device, a transfer device, and a cleaning device. The developing device includes a toner bearing member having a surface subjected to alumite treatment. Toner that is used in the image forming apparatus is magnetic mono-component developer including magnetic toner particles containing at least binder resin and iron-containing magnetic powder, and an external additive to be externally added to the magnetic toner particles. The external additive is formed from inorganic fine particles which have been subjected to surface treatment with a tin-containing compound and an antimony-containing compound. In the image forming apparatus, the ratio of antimony to iron of the toner that has been removed by the cleaning device is double or more the ratio of antimony to iron of the toner before being conveyed by the toner bearing member.

3 Claims, 3 Drawing Sheets

IMAGE FORMING METHOD USING AN EXTERNAL ADDITIVE OF INORGANIC FINE PARTICLES THAT HAVE BEEN SUBJECTED TO SURFACE TREATMENT WITH A TIN-CONTAINING COMPOUND AND AN ANTIMONY-CONTAINING COMPOUND

BACKGROUND OF THE INVENTION

1. Field of the Invention

The present disclosure relates to an image forming apparatus.

2. Description of the Related Art

An image forming apparatus that uses an electrographic system, such as a copier, a printer, a facsimile, or a multifunctional peripheral thereof includes an image bearing member, a charging device which uniformly charges the surface of the image bearing member, an exposure device which forms an electrostatic latent image on the surface of the image bearing member by exposing the surface of the charged image bearing member, a developing device which develops the electrostatic latent image as a toner image by supplying toner to the surface of the image bearing member on which the electrostatic latent image was formed, a transfer device which transfers the toner configuring the toner image from the image bearing member to a recording medium, and a fixing device which fixes the transferred toner image to the recording medium by heating and pressuring it. This kind of image forming apparatus forms an image on the recording medium by using the respective devices described above by forming a toner image on the image bearing member, transferring the toner image to the recording medium, and thereafter fixing the toner image on the recording medium. After the toner is transferred onto the recording medium, the toner remaining on the image bearing member is removed from the image bearing member by a cleaning device having a cleaning blade or the like which comes in contact with a photoreceptor drum that serves as the image bearing member.

The developing device that is provided to this type of image forming apparatus that uses the electrographic system is disposed opposite to the photoreceptor drum as the image bearing member, includes a toner bearing member (development roller) which bears the toner on its surface and thereby conveys the toner, and supplies the toner that was conveyed by the development roller toward the peripheral surface of the photoreceptor drum on which the electrostatic latent image was formed. Consequently, the developing device forms a toner image on the photoreceptor drum.

This kind of developing device is demanded of superior toner conveying performance by the development roller. In order to improve the toner conveying performance, as the development roller, the use of a roller that is subjected to treatment for forming irregularities on the surface of a metal roller is known.

As this kind of development roller, for example, the following rollers are known.

Foremost, as a first example, there is a powder bearing member in which the surface layer is at least made from an aluminum material, and an alumite treated layer is formed on the surface after being subjected to sandblast treatment.

Moreover, as a second example, there is a cylindrical developer bearing member including an alumite layer coated on a conductive substrate surface that was subjected to uniform roughening, and in which the alumite layer includes uniform micropores that reach the substrate surface.

SUMMARY OF THE INVENTION

An object of the present disclosure is to provide an image forming apparatus capable of inhibiting the occurrence of the development memory phenomenon and forming high quality images.

One aspect of the present disclosure is an image forming apparatus including an image bearing member on which an electrostatic latent image is formed, a developing device which is disposed opposite to the image bearing member, includes a toner bearing member which bears toner on its surface and conveys the toner, develops the electrostatic latent image formed on the image bearing member with the toner that has been conveyed by the toner bearing member, and forms a toner image on the image bearing member, a transfer device which transfers the toner image formed by the developing device, to a recording medium, and a cleaning device which removes the toner remaining on the image bearing member after the transfer. The surface of the toner bearing member is subjected to alumite treatment. The toner is magnetic mono-component developer including magnetic toner particles containing at least binder resin and iron-containing magnetic powder, and an external additive to be externally added to the magnetic toner particles. The external additive is formed from inorganic fine particles which have been subjected to surface treatment with a tin-containing compound and an antimony-containing compound. The ratio of antimony to iron of the toner that has been removed by the cleaning device is double or more the ratio of antimony to iron of the toner before being conveyed by the toner bearing member.

DETAILED DESCRIPTION OF THE PREFERRED EMBODIMENTS

Figure 1:
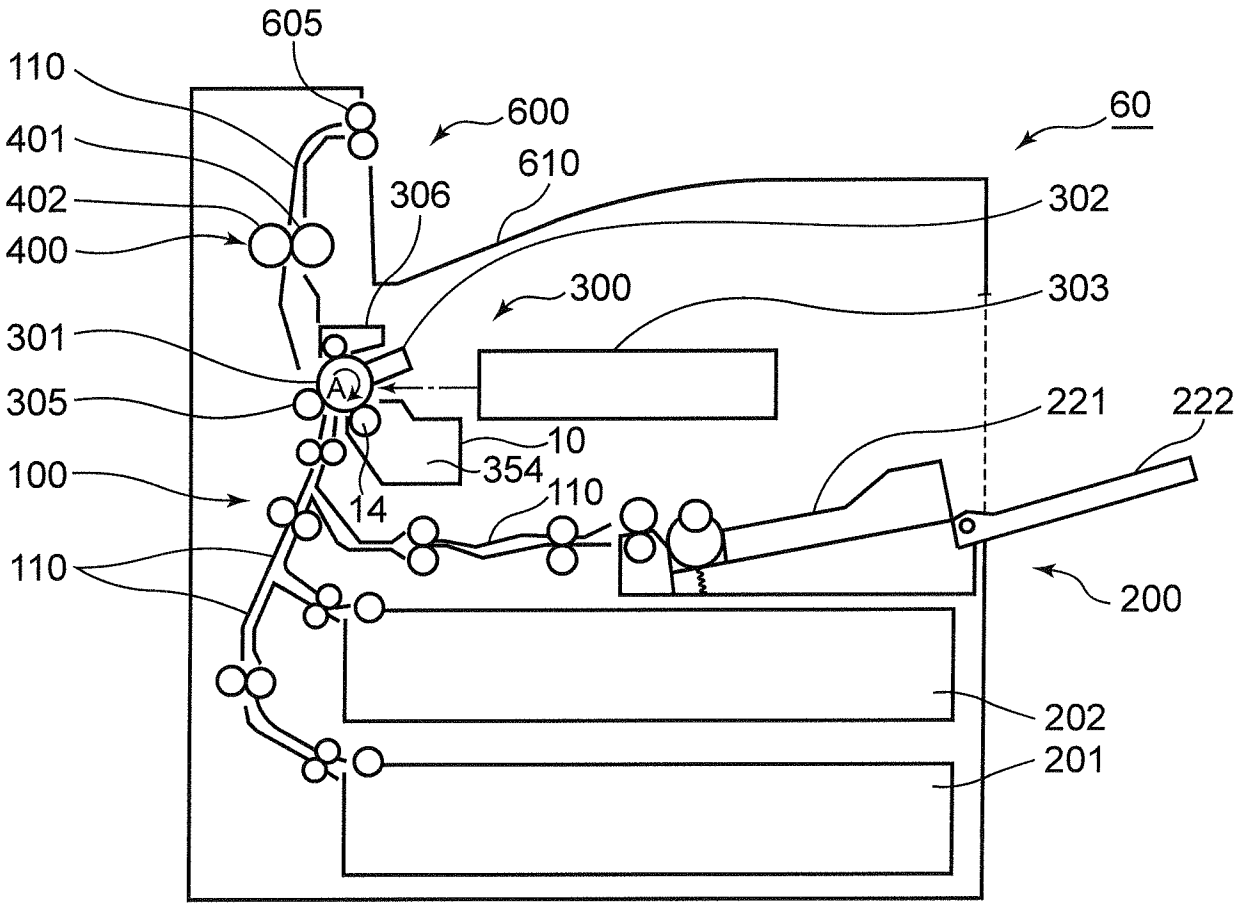
FIG. 1 is a schematic diagram showing the general configuration of the image forming apparatus according to an embodiment of the present disclosure.

When the foregoing metal roller that was subjected to treatment for forming irregularities on its surface is uses as the development roller, it is considered that the toner gets hooked in the concave part, and the toner conveying performance is improved thereby. If the shape of these irregularities is lost, it is considered that the toner conveying performance will deteriorate, and there is a case when the development roller needs to be replaced. Thus, it is considered that the maintenance of these irregularities even when the development roller is used for a long period of time is important from the perspective of prolonging the life of the development roller.

Nevertheless, when a relatively inexpensive aluminum roller is used as the development roller, even though the initial toner conveying performance can be improved by forming irregularities on the surface thereof, there is a problem in that it is difficult to maintain such superior toner conveying performance. This is considered to be a result of the aluminum roller having low abrasion resistance, and, as a result of being used as a development roller, the shape of the irregularities formed on the surface is easily lost.

Moreover, according to the first example, an alumite treated layer is formed on the sandblasted irregular surface by utilizing the fact that the surface is made of an aluminum material, and, as a result of this alumite treated layer being a ceramic material, it is expected to be capable of inhibiting the abrasion of the sandblasted irregular surface. In addition, based on the porous structure of the alumite layer itself, it is expected that the sandblasted irregular surface can be further roughened so as to average the level of roughening thereof. Thus, it is expected that the stable supply of powder by the uniformly bearing and conveying of powder can be guaranteed over a long period of time.

Nevertheless, when image formation is performed upon using the powder bearing member of the first example as the development roller, there was a possibility that an uneven image would be formed on the recording medium. This is considered to be a result of the following reasons. Since an alumite treated layer has relatively high electrical resistance; that is, relatively low conductivity, it is considered that, after developing an electrostatic latent image formed on the photoreceptor drum with the toner that was conveyed by the development roller, electric charge tends to remain on the surface of the development roller. This kind of residual charge is considered to affect the charging of that toner upon forming a toner thin layer on the development roller for the subsequent development. Consequently, it is considered that it is not possible to form a uniform toner thin layer on the development roller, and it is considered that the current development is affected by the previous development. In other words, it is considered that the development memory phenomenon in which the history of the previous development remains on the toner thin layer formed on the development roller occurs. Due to the occurrence of this development memory phenomenon, it is considered that uneven images occur in the image formed on the recording medium (considered that an image that has a part having uneven image density may be formed on the recording medium).

Moreover, according to the second example, it is expected that a cylindrical developer bearing member can be obtained, the toner is subjected to sufficient frictional charging on the toner development sleeve thereof even after repeated use, and can be supported and conveyed as a uniform layer without any bias, without any difference in the development capacity based on the development history.

It is considered that this kind of cylindrical developer bearing member inhibits the occurrence of the image memory phenomenon by causing the residual charge to escape as a result of forming, on the alumite layer, micropores that reach the substrate.

Nevertheless, the cylindrical developer bearing member of the second example did not possess sufficiently high toner conveying performance. The reason for this is considered to be because, since the treatment for forming the micropores is performed after once performing the roughening treatment and the alumite treatment, the irregularities that were formed in the roughening treatment become lost. Moreover, since the numerous and complex treatment processes are required, the manufacturing cost will increase.

Moreover, among the image forming apparatuses using an electrographic system, there are types that use, as the developer, magnetic mono-component developer which contains magnetic toner but does not contain carrier; that is, magnetic toner. Generally speaking, as this type of magnetic toner, inorganic fine particles are added to the magnetic toner particles containing binder resin and magnetic powder in order to adjust the fluidity and charging characteristics of the magnetic toner particles. In addition, as these inorganic fine particles, those which are subjected to hydrophobization treatment to become tolerant to external environmental influence are used. Nevertheless, although these inorganic fine particles; for example, the titanium oxide particles and the like can adjust the resistance of the magnetic toner, but if they are subjected to hydrophobization treatment, there were cases where the resistance of them would increase. Thus, as a result of performing hydrophobization treatment to the inorganic fine particles that were subjected to surface treatment with a conductive material such as a tin-containing compound or an antimony-containing compound, it is considered that it is possible to inhibit the resistance of the obtained external additive from becoming too high.

The occurrence of the development memory phenomenon is considered to be due to the residual charge on the surface of the toner bearing member as described above. In other words, this considered to be a result of the resistance of the alumite layer, which was obtained by the alumite treatment that was performed for maintaining the toner conveying performance of the toner bearing member, being high.

In addition, attention was focuses on using, as the toner, to which inorganic fine particles, that were subjected to surface treatment with a conductive material such as a tin-containing compound or an antimony-containing compound, were added. It was considered that, as a result of this conductive material being appropriately transferred to the toner bearing member surface, it would be possible to inhibit the electric charge on the surface of the toner bearing member from remaining.

Thus, as a result of focusing attention on the above and conducting intense study regarding the conditions for sufficiently inhibiting the occurrence of the development memory phenomenon, the present disclosure as described below was conceived.

The image forming apparatus according to an embodiment of the present disclosure is now explained in detail with reference to the appended drawings. As the image forming apparatus, the image forming apparatus configured as shown in the diagrams is taken as an example in the ensuing explanation, but there is no particular limitation so as long as it is an image forming apparatus using an electrographic system. For example, a copier, a facsimile device, a printer and the like may be used. Moreover, although a photoreceptor drum, which is a drum-shaped photoreceptor, is taken as an example of the image bearing member in the ensuing explanation, it is not limited thereto, and a belt-shaped photoreceptor or a sheet-shaped photoreceptor can also be used.

FIG. 1 is a schematic diagram showing the general configuration of the image forming apparatus (printer) 60 according to an embodiment of the present disclosure. The image forming apparatus 60 includes a paper feeding unit 200 disposed at the lower part of the image forming apparatus body, an image forming unit 300 disposed above the paper feeding unit 200, a fixing unit 400 disposed on a side that is more on the ejection side (downstream side in the sheet conveying direction) than the image forming unit 300, and a paper ejection unit 600 disposed at the upper part of the image forming apparatus body. Moreover, the image forming apparatus body is provided with a sheet conveying unit 100 for connecting the paper feeding unit 200, the image forming unit 300, the fixing unit 400, and the paper ejection unit 600.

The image forming unit 300 is used for forming a toner image on a sheet which serves as a recording medium based on the electrographic system. Note that the configuration of the image forming unit 300 will be described later.

The fixing unit 400 is disposed on the downstream side in the sheet conveying direction of the image forming unit 300. The fixing unit 400 fixes the unfixed toner image, which was formed on the sheet, to the sheet by sandwiching the sheet to which the toner image was formed by the image forming unit 300 with a heating roller 401 and a pressure roller 402 and thereby heating and pressurizing the sheet.

The paper feeding unit 200 is used for feeding the sheets. The paper feeding unit 200 includes a plurality of paper feeding cassettes 201, 202, 221. The paper feeding cassette 221 among the above serves as a bypass tray for supplying the sheets from the side surface of the image forming apparatus, and can be closed with a cover 222.

A sheet conveying path 110 is connected to the respective paper feeding cassettes 201, 202, 221. The sheet conveying path 110 heads toward the image forming unit 300, and further heads toward the paper ejection unit 600 via the fixing unit 400. The sheet conveying unit 100 is configured from the sheet conveying paths 110. Moreover, the sheet to which the toner image was transferred and fixed is ejected to a catch tray 610 by a paper ejection roller pair 605 of the paper ejection unit 600.

Figure 2:
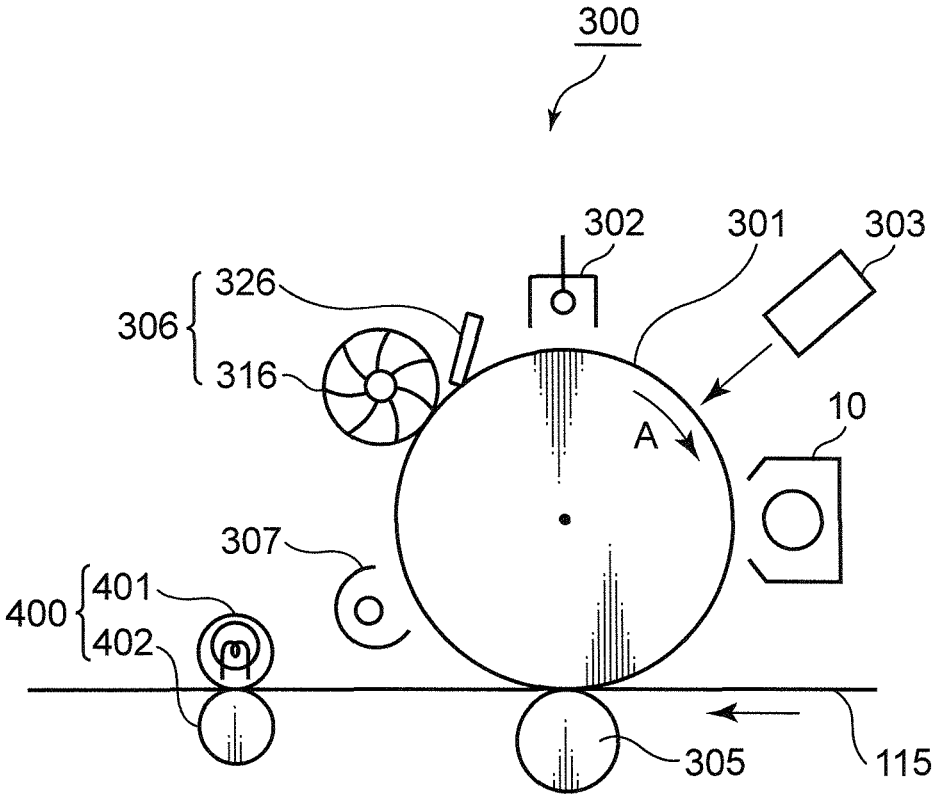
FIG. 2 is a schematic diagram showing an image forming unit and the periphery thereof of the image forming apparatus according to an embodiment of the present disclosure.

FIG. 2 is a schematic diagram showing the image forming unit 300 of the image forming apparatus 60 and periphery thereof. The image forming unit 300 is used for forming a toner image on the sheet 115 as the recording medium using the electrographic system. Moreover, in the image forming unit 300, as shown in FIG. 2, the photoreceptor drum 301 as the image bearing member, which is rotatable in the direction of arrow A, is disposed at the center position. Moreover, the image forming unit 300 includes, in order along the rotating direction A of the photoreceptor drum 301 and around the photoreceptor drum 301, a charging device 302, an exposure device 303, a developing device 10, a transfer device 305, a neutralizing device 307, and a cleaning device 306. Note that the neutralizing device 307 and the cleaning device 306 may be disposed the other way around.

There is no particular limitation in the photoreceptor drum 301 so as long as it can be provided to an image forming apparatus that uses the electrographic system. Specifically, an amorphous silicon photoreceptor or an organic photoreceptor can be used. Among the above, the amorphous silicon photoreceptor can be preferably used. Consequently, it is possible to inhibit the occurrence of the development memory phenomenon, inhibit the deterioration in the toner conveying performance of the toner bearing member for a long period of time, and obtain an image forming apparatus with a highly durable image bearing member.

The charging device 302 is used for charging the peripheral surface of the photoreceptor drum 301 that is rotating in the arrow direction. There is no particular limitation in the charging device 302 so as long as it is a charging device that can be provided in the image forming apparatus. Specifically, for example, used may be a charging device, which may be a contact charging system which includes a charging roller and charges the peripheral surface of the photoreceptor drum by applying a predetermined charging bias voltage to the charging roller, or a non-contact discharge system including a corotron-type or a scorotron-type charging device.

The exposure device 303 is used for irradiating a laser beam or LED light based on the image information to the peripheral surface of the photoreceptor drum 301 whose peripheral surface was charged by the charging device 302, and forming an electrostatic latent image based on the image information on the peripheral surface of the photoreceptor drum 301. There is no particular limitation in the exposure device 303 so as long as it is an exposure device that can be provided in an image forming apparatus. Specifically, for example, used may be an LED head unit or a laser scanning unit (LSU).

The developing device 10 is used for developing the electrostatic latent image formed on the surface of the photoreceptor drum 301 with the toner, and forming a toner image. Note that the configuration of the developing device 10 will be described later.

The transfer device 305 is used for transferring the toner image that was formed on the photoreceptor drum 301 onto the sheet 115.

The neutralizing device 307 is used for neutralizing the surface charge of the photoreceptor drum 301 after the toner image is transferred onto the sheet 115 by the transfer device 305.

The cleaning device 306 is used for removing the toner remaining on the photoreceptor drum 301 after the toner image is transferred onto the sheet 115 by the transfer device 305. The cleaning device 306 includes, for example, a fur brush 316 and a rubber blade 326. Note that the illustrated cleaning device 306 includes both the fur brush 316 and the rubber blade 326, but it is possible to also include only one. Moreover, the waste toner that was removed by the cleaning device 306 passes through a predetermined route and is conveyed to and stored in a toner recovery bottle not shown.

In addition, the image forming apparatus 60 includes, as described above, a fixing unit disposed downstream of the image forming unit 300 in the conveying direction of the sheet 115. The fixing unit 400 applies heat and pressure to the sheet 115 on which the toner image was transferred, and thereby fixes the toner image. It is thereby possible to form the intended image on the sheet 115.

Figure 3:
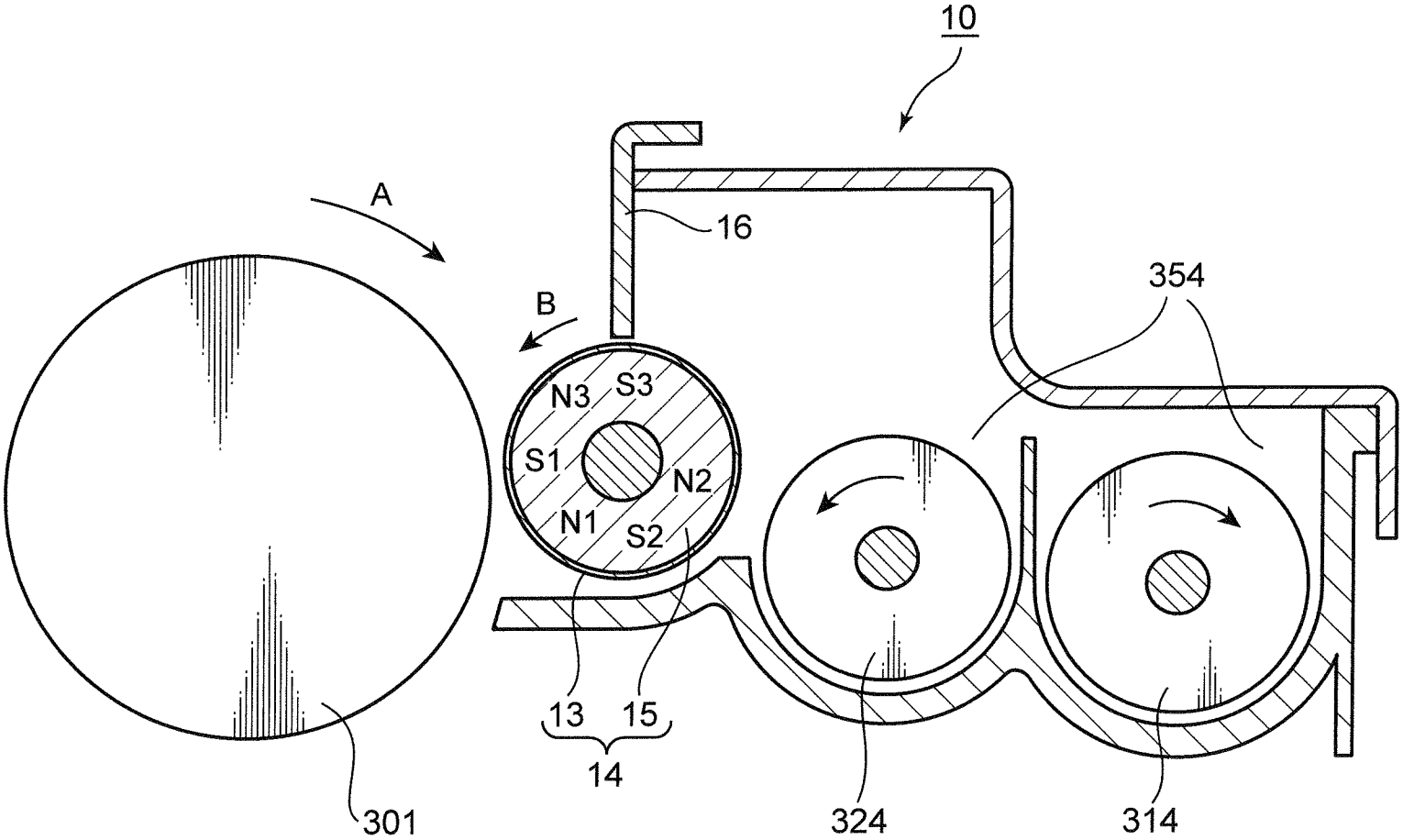
FIG. 3 is a schematic cross section showing a developing device provided in the image forming apparatus according to an embodiment of the present disclosure.

The developing device 10 provided in the image forming apparatus 60 is now explained. FIG. 3 is a schematic cross section showing the developing device 10, and also shows the photoreceptor drum 301.

The developing device 10 includes a toner housing part 354 for housing magnetic toner as the magnetic mono-component developer, two agitation rollers 314, 324 for agitating the toner, a development roller 14 for transferring the toner to the surface of the photoreceptor drum 301, and a blade 16 disposed to face the development roller 14; in other words, it is a magnetic mono-component developing device.

The development roller 14 is a toner bearing member including a cylindrical rotating sleeve 13, and a fixed magnet 15 that is included in the rotating sleeve 13 but does not come in contact with the rotating sleeve 13. The development roller (toner bearing member) 14 is configured so that the rotating sleeve 13 rotates around the fixed magnet 15 in a state where the position of the fixed magnet 15 is fixed. Moreover, the blade 16 is provided to face the rotating sleeve 13 of the development roller 14.

Moreover, the surface of the development roller 14 as the toner bearing member is subjected to alumite treatment. In other words, it is a development roller including the rotating sleeve 13 whose surface was subjected to alumite treatment. There is no particular limitation in the alumite treatment so as long as it is treatment that can form an alumite layer on the surface. Specifically, for example, anodization of the aluminum element tube can be performed. More specifically, for example, anodization that uses a sulfuric acid aqueous solution as the electrolytic solution can be performed. Although there is no particular limitation in the treatment time in the foregoing case, for example, the treatment time is preferably around 0.5 to 300 minutes. Moreover, although there is no particular limitation in the concentration of the electrolytic solution, for example, the concentration is preferably around 0.1 to 80 mass percent when using a sulfuric acid aqueous solution as the electrolytic solution. Moreover, although there is no particular limitation in the formation voltage during the anodization, for example, the formation voltage is preferably around 10 to 200 V.

The agitation rollers 314, 324 include spiral blades, and they convey the toner in mutually opposite directions while agitating the toner. In addition, the agitation roller 324 supplies the agitated toner to the development roller 14.

The toner that is supplied to the development roller 14 is attracted to the surface of the rotating sleeve 13 by the magnetic force of a fixed magnet. As a result of the rotating sleeve 13 rotating in a state where the toner is attracted, the toner is conveyed to the layer thickness restricting position by the blade 16, and then passes by the layer thickness restricting position. Here, the layer thickness of the toner layer on the rotating sleeve 13 is adjusted, and a toner thin layer of a suitable thickness is formed, and the toner is charged. As a result of the rotating sleeve 13 further rotating in a state where the toner thin layer made of charged toner is formed on the surface thereof, the toner thin layer is conveyed to the vicinity of the photoreceptor drum 301. Subsequently, the toner of the toner thin layer that was conveyed to the vicinity of the photoreceptor drum 301 is transferred to the photoreceptor drum 301 by the potential difference that was generated between the electrostatic latent image formed on the photoreceptor drum 301 and the development bias potential applied to the development roller 14. Based on this kind of operation, the developing device 10 performs the development based on the electrostatic latent image formed on the photoreceptor drum 301.

Moreover, as the toner that is used in the image forming apparatus, there is no particular limitation so as long as it is magnetic mono-component developer including magnetic toner particles containing at least binder resin and iron-containing magnetic powder, and an external additive to be externally added to the magnetic toner particles, and the external additive is formed from inorganic fine particles which have been subjected to surface treatment with a tin-containing compound and an antimony-containing compound. Note that the configuration of the toner will be described later.

The image forming apparatus according to the present embodiment includes the foregoing image bearing member, developing device, transfer device, and cleaning device, the surface of the toner bearing member provided to the developing device is subjected to alumite treatment, uses the magnetic mono-component developer (magnetic toner) in which the inorganic fine particles that were subjected to surface treatment with a tin-containing compound and an antimony-containing compound were externally added to the magnetic toner particles, and the ratio of antimony to iron of the toner that has been removed by the cleaning device is double or more the ratio of antimony to iron of the toner before being conveyed the toner bearing member.

Note that, in the present disclosure, the surface of the toner bearing member that is provided to the developing device is subjected to alumite treatment, and, so as long as it is an image forming apparatus including a magnetic mono-component developing device which uses the magnetic mono-component developer (magnetic toner) in which inorganic fine particles subjected to surface treatment with the tin-containing compound and the antimony-containing compound were externally added to the magnetic toner particles, the image forming apparatus is not limited to the foregoing configuration. In other words, the image forming apparatus according to the present embodiment is characterized in including an image bearing member on which an electrostatic latent image is formed, a developing device which is disposed opposite to the image bearing member, includes a toner bearing member which bears toner on its surface and conveys the toner, develops the electrostatic latent image formed on the image bearing member with the toner that has been conveyed by the toner bearing member, and forms a toner image on the image bearing member, a transfer device which transfers the toner image formed by the developing device, to a recording medium, and a cleaning device which removes the toner remaining on the image bearing member after the transfer, wherein a surface of the toner bearing member is subjected to alumite treatment, the toner is magnetic mono-component developer including magnetic toner particles containing at least binder resin and iron-containing magnetic powder, and an external additive to be externally added to the magnetic toner particles, the external additive is formed from inorganic fine particles which have been subjected to surface treatment with a tin-containing compound and an antimony-containing compound, and the ratio of antimony to iron of the toner that has been removed by the cleaning device is double or more the ratio of antimony to iron of the toner before being conveyed by the toner bearing member.

According to the foregoing configuration, it is possible to provide an image forming apparatus capable of inhibiting the development memory phenomenon and forming high quality images.

This is speculated to be based on the following reasons.

Foremost, iron in the ratio of antimony to iron of the toner before being conveyed by the toner bearing member and the ratio of antimony to iron of the toner that has been removed by the cleaning device is considered to derive from the magnetic powder contained in the magnetic toner particles, and depend on the amount of the magnetic toner particles. In addition, antimony in the foregoing case is considered to derive from the antimony-containing compound which contributes to the surface treatment of the external additive, and depend on the amount of the tin-containing compound and the antimony-containing compound which contribute to the surface treatment of the external additive.

Thus, when the ratio of antimony to iron of the toner that has been removed by the cleaning device is double or more the ratio of antimony to iron of the toner before being conveyed by the toner bearing member, since the magnetic toner particles are consumed and the amount thereof will decrease due to the development, it is considered that this represents that the reduction of the tin-containing compound and the antimony-containing compound which are contributing to the surface treatment of the external additive is less than the reduction of the magnetic toner particles. Based on the above, it is considered that the tin-containing compound and the antimony-containing compound which are adhered to the inorganic fine particles as the conductive material are adhered to the inorganic fine particles relatively weakly. In addition, it is considered that the amount of the tin-containing compound and the antimony-containing compound which are adhered to the inorganic fine particles as the conductive material that is being transferred to the toner bearing member is great. Thus, it is considered that it is thereby possible to reduce the resistance of the surface of the toner bearing member and inhibit the occurrence of the development memory phenomenon.

Meanwhile, when the ratio of antimony to iron of the toner that has been removed by the cleaning device is less than double the ratio of antimony to iron of the toner before being conveyed by the toner bearing member, it is considered that this represents that, when the amount of the magnetic toner particles decreases due to the development, the amount of reduction of the tin-containing compound and antimony-containing compound which are contributing to the surface treatment of the external additive is also relatively great. Based on the above, it is considered that the tin-containing compound and the antimony-containing compound which are adhered to the inorganic fine particles as the conductive material are adhered to the inorganic fine particles relatively strongly. In addition, it is considered that the amount of the tin-containing compound and the antimony-containing compound which are adhered to the inorganic fine particles as the conductive material that is being transferred to the toner bearing member is small. Thus, it is considered that the resistance lowering of the surface of the toner bearing member is insufficient and that occurrence of the development memory phenomenon cannot be sufficiently inhibited.

Accordingly, it is considered that it is possible to sufficiently inhibit the occurrence of the development memory phenomenon even though a toner bearing member having a surface subjected to alumite treatment is used, and maintain the toner conveyed performance even if image formation is performed for a long period time since the surface of the toner bearing member was subjected to alumite treatment.

Note that the ratio of antimony to iron can be obtained, for example, as follows.

Foremost, the ratio of antimony to iron of the toner before being conveyed by the toner bearing member can be calculated from the intensity ratio of the peak derived from iron and the peak derived from antimony that are obtained by analyzing, with an X-ray fluorescence spectrometer, the toner before being conveyed by the toner bearing member; for example, the toner housed in the toner housing part 354, or toner before being housed in the toner housing part 354.

Subsequently, the ratio of antimony to iron of the toner that has been removed by the cleaning device can be calculated from the intensity ratio of the peak derived from iron and the peak derived from antimony that are obtained by analyzing, with an X-ray fluorescence spectrometer, the toner that has been removed from the photoreceptor drum 301 by the cleaning device 306 and recovered in a toner recovery bottle (waste toner box).

In other words, the ratio of antimony to iron can be calculated from the intensity ratio of the peak derived from iron and the peak derived from antimony that are obtained by analyzing, with an X-ray fluorescence spectrometer, the toner before being conveyed by the toner bearing member and the toner that has been removed from the image bearing member by the cleaning device, respectively.

There is no particular limitation in the X-ray fluorescence spectrometer that can be used for obtaining the ratio of antimony to iron, and, for example, RIX2100 manufactured by Rigaku Corporation can be used.

Note that, when the ratio of antimony to iron of the toner that has been removed by the cleaning device is double or more the ratio of antimony to iron of the toner before being conveyed by the toner bearing member, this means that, when the ratio of antimony to iron of the toner before being conveyed by the toner bearing member is A and the ratio of antimony to iron of the toner that has been removed by the cleaning device is B, $B/A \geq 2$ is satisfied.

Moreover, with the image forming apparatus according to the present embodiment, it will suffice if the ratio of antimony to iron of the toner that has been removed by the cleaning device is double or more the ratio of antimony to iron of the toner before being conveyed by the toner bearing member, but it is preferably triple or more. In other words, preferably, $B/A \geq 3$ is satisfied. Consequently, it is possible to further inhibit the development memory phenomenon and form higher quality images. The reason for this is considered to be because the tin-containing compound and antimony-containing compound which are adhered to the inorganic fine particles as the conductive material are transferred to the surface of the development roller in a greater quantity.

As B/A is greater, it is considered that the development memory phenomenon can be further inhibited. The reason for this is considered to be because the transfer amount of the tin-containing compound and antimony-containing compound which are adhered to the inorganic fine particles as the conductive material to the surface of the development roller will increased.

Meanwhile, from a different perspective of the occurrence of the development memory phenomenon, the ratio of antimony to iron of the toner that has been removed by the cleaning device is preferably less than or equal to ten times the ratio of antimony to iron of the toner before being conveyed by the toner bearing member; that is, $B/A \leq 10$. Specifically, if B/A is too great, there is a possibility that the image concentration may reduce or fogging may occur. The reason for this is considered to be because, if B/A is too great, the amount of the tin-containing compound and antimony-containing compound which are adhered to the inorganic fine particles as the conductive material becomes too great, which may obstruct the charging of the toner or affect the charging of the photoreceptor drum.

Moreover, the image forming apparatus merely needs to be configured so that the ratio A of antimony to iron of the toner that has been removed by the cleaning device relative to the ratio B of antimony to iron of the toner before being conveyed by the toner bearing member satisfies the foregoing relationship, and there is no particular limitation in the method thereof. Specifically, for example, upon manufacturing the toner, it is possible to use an external additive that was obtained by adjusting the adhesion force between the tin-containing compound and antimony-containing compound which are adhered to the inorganic fine particles as the conductive material, and the inorganic fine particles.

[Toner]

There is no limitation in the toner that is used herein so as long as it is magnetic mono-component developer (magnetic toner) including magnetic toner particles (toner mother particles) containing at least binder resin and iron-containing magnetic powder, and an external additive to be externally added to the magnetic toner particles, the external additive is inorganic fine particles which have been subjected to surface treatment with a tin-containing compound and an antimony-containing compound, and the foregoing B/A is 2 or more. Specifically, for example, the following can be used.

<Magnetic Toner Particles>

The magnetic toner particles are toner particles including at least binder resin and iron-containing magnetic powder as described above. Moreover, the particle diameter thereof is, for example, preferably 4.5 to 9 μm based on a mean volume particle diameter.

(Binder Resin)

There is no particular limitation in the binder resin so as long as it has been used as the binder resin of the toner mother particles from the past. Specifically, for example, polystyrene-based resin such as styrene-acrylic resin and styrene-butadiene resin; olefinic resin such as acrylic resin; polyethylene-based resin, and polypropylene-based resin; vinyl chloride-based resin; polyester-based resin; polyamide-based resin; polyurethane-based resin; polyvinyl alcohol-based resin; vinyl ether-based resin; and N-vinyl-based resin can be used. Among the above, polyester-based resin and styrene-acrylic resin are preferably used since they have a relatively low softening point, superior low temperature fixing performance, and broad non-offset temperature range. Moreover, as the binder resin, each of the foregoing binder resin can be used independently or in a combination of two or more types.

As the polyester-based resin, for example, those obtained by the condensation polymerization or co-condensation polymerization of the alcohol component and carboxylic acid component can be used. Moreover, as the components to be used in the synthesis of the polyester-based resin, there are the following.

There is no particular limitation in the alcohol component so as long as it is alcohol that can be used for synthesizing the polyester-based resin. Moreover, as the alcohol component, alcohol (dihydric or higher polyhydric alcohol) with two or more hydroxyl groups in the molecules needs to be contained. Among those which can be used as the alcohol component, as the dihydric alcohol; specifically, for example, used may be diols such as ethylene glycol, diethylene glycol, triethylene glycol, 1,2-propylene glycol, 1,3-propylene glycol, 1,4-butanediol, neopentyl glycol, 1,4-butenediol, 1,5-pentanediol, 1,6-hexanediol, 1,4-cyclohexanedimethanol, dipropylene glycol, polyethylene glycol, polypropylene glycol, and polytetramethylene glycol; and bisphenols such as bisphenol A, hydrogen-added bisphenol A, polyoxyethylenated bisphenol A, and polyoxypropylenated bisphenol A. Moreover, among those which can be used as the alcohol component, as trihydric alcohol or greater; specifically, for example, used may be sorbitol, 1,2,3,6-hexantetrol, 1,4-sorbitan, pentaerythritol, dipentaerythritol, tripentaerythritol, 1,2,4-butanetriol, 1,2,5-pentanetriol, glycerol, diglycerol, 2-methylpropanetriol, 2-methyl-1,2,4-butanetriol, trimethylolethane, trimethylolpropane, and 1,3,5-trihydroxymethylbenzene. Moreover, as the alcohol component, each of the foregoing components can be used independently or in a combination of two or more types.

Moreover, there is no particular limitation in the carboxylic acid component so as long as it can be uses as carboxylic acid for synthesizing the polyester-based resin. Moreover, as the carboxylic acid component, acid anhydride and lower alkyl ester of the carboxylic acid are also included in addition to the carboxylic acid. As the carboxylic acid component, carboxylic acid (dicarboxylic or higher polycarboxylic acid) with two or more hydroxyl groups in the molecules needs to be contained. Among those which can be used as the carboxylic acid, as the dicarboxylic acid; specifically, for example, used may be maleic acid, fumaric acid, citraconic acid, itaconic acid, glutaconic acid, phthalic acid, isophthalic acid, terephthalic acid, cyclohexane dicarboxylic acid, succinic acid, adipic acid, sebacic acid, azelaic acid, malonic acid, alkyl succinic acid, and alkenyl succinic acid. As the alkyl succinic acid, for example, used may be n-butyl succinic acid, n-octyl succinic acid, n-dodecyl succinic acid, and isododecyl succinic acid. As the alkenyl succinic acid, for example, used may be n-butenyl succinic acid, isobutyl succinic acid, isobutenyl succinic acid, n-octenyl succinic acid, n-dodecenyl succinic acid, and isododecenyl succinic acid. Moreover, among those which can be used as the carboxylic acid component, as the tricarboxylic acid or greater; specifically, for example, used may be 1,2,4-benzene tricarboxylic acid (trimellitic acid), 1,2,5-benzene tricarboxylic acid, 2,5,7-naphthalene tricarboxylic acid, 1,2,4-naphthalene tricarboxylic acid, 1,2,4-butane tricarboxylic acid, 1,2,5-hexane tricarboxylic acid, 1,3-dicarboxylic-2-methyl-2-methylene carboxy propane, 1,2,4-cyclohexane tricarboxylic acid, tetra(methylene carboxyl)methane, 1,2,7,8-octane tetracarboxylic acid, pyromellitic acid, and EnPol trimer acid. Moreover, as the carboxylic acid component, each of the foregoing components can be used independently or in a combination of two or more types.

As the polystyrene-based resin, it may be a styrene homopolymer or a copolymer with other copolymerized monomers that can be copolymerized with styrene. As the copolymerized monomer, used may be olefin-based hydrocarbons (alkene) such as p-choloro styrene, vinyl naphthalene, ethylene, propylene, butylene, and isobutylene; vinyl halides such as vinyl chloride, vinyl bromide, and vinyl fluoride; vinyl esters such as vinyl acetate, vinyl propionate, vinyl benzoate, and vinyl butyrate; ester acrylates such as methyl acrylate, ethyl acrylate, n-butyl acrylate, isobutyl acrylate, dodecyl acrylate, n-octyl acrylate, 2-choloroethyl acrylate, phenyl acrylate, and α-choloro methyl acrylate; methacrylate esters such as methyl methacrylate, ethyl methacrylate, and butyl methacrylate; acrylic acid derivatives such as acrylonitrile, metaacrylonitrile, and acrylamide; vinyl ethers such as vinyl methyl ether, and vinyl isobutyl ether; vinyl ketones such as methyl vinyl ketone, ethyl vinyl ketone, and methyl isopropenyl ketone; and N-vinyl compounds such as N-vinylpyrrole, N-vinylcarbazole, N-vinylindole, and N-vinylpyrrolidone. Moreover, as the copolymerized monomer, each of the foregoing monomers can be used independently or in a combination of two or more types.

As the binder resin, from the perspective of fixing performance, it is preferable to use the foregoing thermoplastic resin, but the thermoplastic resin does not need to be used alone, and a cross-linking agent or thermosetting resin may be combined with the thermoplastic resin. As a result of introducing a partial bridged structure in the binder resin, it is possible to improve the anti-offset properties while inhibiting the deterioration in the fixing performance during the fixation of the toner to the sheet.

As the thermosetting resin; specifically, for example, epoxy-based resin such as bisphenol A-type epoxy resin, hydrogenated bisphenol A-type epoxy resin, novolac-type epoxy resin, polyalkylene ether-type epoxy resin, and annular aliphatic system epoxy resin, and cyanate-based resin such as cyanate resin can be used. These may be used independently or in a combination of two or more types.

(Iron-Containing Magnetic Powder)

There is no particular limitation in the iron-containing magnetic powder so as long as it is magnetic powder containing iron. Specifically, for example, ferrite or magnetite can be used. Moreover, the particle diameter is preferably 0.1 to 1 μm based on a mean number particle diameter, and more preferably 0.1 to 0.5 μm.

Moreover, although there is no particular limitation in the content of the iron-containing magnetic powder, the content is preferably 35 to 60 parts by mass and more preferably 40 to 60 parts by mass relative to 100 parts by mass of the magnetic toner particles (toner mother particles). If the content of the iron-containing magnetic powder is too small, there is a possibility that the image concentration will decrease. Moreover, if the content of the iron-containing magnetic powder is too great, there is a possibility that the fixing performance will deteriorate due to the low binder resin content.

(Wax)

It is standard for the magnetic toner particles (toner mother particles) to contain wax in order to improve the fixing performance and offset properties.

As the wax, there is no particular limitation so as long as it has been used as wax of the toner mother particles from the past. Preferably, for example, olefin-based wax such as polyethylene wax and polypropylene wax, fluororesin-based wax such as polytetrafluoroaethylene-based wax, Fischer-Tropsch wax, paraffin wax, ester wax, montan wax, rice wax and the like can be used. The foregoing wax can be used independently or in a combination of two or more types. By adding the foregoing wax, the fixation offset and image smearing can be efficiently prevented.

Although there is no particular limitation in the wax content, the content is preferably 1 to 5 parts by mass relative to 100 parts by mass of the binder resin. If the wax content is too small, there is a possibility that the fixation offset and image smearing cannot be efficiently prevented. Meanwhile, if the blending quantity of wax is too great, the toners themselves will become fused, and there is a possibility that the preservation stability of toner will deteriorate.

(Charge-Controlling Agent)

The magnetic toner particles (toner mother particles) generally contain a charge-controlling agent for controlling the charging characteristics such as the frictional charging characteristics of the toner. The charge-controlling agent is blended to considerably improve the charging level and charge rise characteristics (index of charging to a constant electric charge level in a short period of time), and obtain superior characteristics in terms of durability and stability. In other words, a charge-controlling agent with positive charging characteristics (positive charging characteristic charge-controlling agent) can be added when performing the development by positively charging the toner, and a charge-controlling agent with negative charging characteristics (negative charging characteristic charge-controlling agent) can be added when performing the development by negatively charging the toner.

There is no particular limitation in the charge-controlling agent so as long as it is a charge-controlling agent of the toner mother particles which have been used from the past.

As specific examples of the charge-controlling agent with positive charging characteristics, there are, for example, azine compounds such as pyridazine, pyrimidine, pyrazine, orthooxazine, metaoxazine, paraoxazine, orthothiazine, metathiazine, parathiazine, 1,2,3-triazine, 1,2,4-triazine, 1,3,5-triazine, 1,2,4-oxadiazine, 1,3,4-oxadiazine, 1,2,6-oxadiazine, 1,3,4-thiadiazine, 1,3,5-thiadiazine, 1,2,3,4-tetrazine, 1,2,4,5-tetrazine, 1,2,3,5-tetrazine, 1,2,4,6-oxatriazine, 1,3,4,5-oxatriazine, phthalazine, quinazoline, and quinoxaline; direct dyes made from azine compounds such as azine fast red FC, azine fast red 12BK, azine violet BO, azine brown 3G, azine light brown GR, azine dark green BH/C, azine deep black EW and azine deep black 3RL; nigrosine compounds such as nigrosine, nigrosine salt, and nigrosine derivative; acid dyes made from nigrosine compounds such as nigrosine BK, nigrosine NB, and nigrosine Z; metal salts of naphthenic acid or higher fatty acid; alkoxylated amine; alkyl amide; and quaternary ammonium salts such as benzyl methyl hexyldecyl ammonium, and decyltrimethyl ammonium chloride. These may be used independently or in a combination of two or more types. In particular, a nigrosine compound is optimal to be contained to the positive charging characteristics toner from the perspective of obtaining the charge rise properties more quickly.

Moreover, as the positive charging characteristic charge-controlling agent, also used may be resin or oligomer that contains quaternary ammonium salt, carboxylic acid salt or carboxyl group as its functional group. More specifically, used may be styrene-based resin containing quaternary ammonium salt, acrylic resin containing quaternary ammonium salt, styrene-acrylic resin containing quaternary ammonium salt, polyester-based resin containing quaternary ammonium salt, styrene-based resin containing carboxylic acid salt, acrylic resin containing carboxylic acid salt, styrene-acrylic resin containing carboxylic acid salt, polyester-based resin containing carboxylic acid salt, polystyrene-based resin containing a carboxyl group, acrylic resin containing a carboxyl group, styrene-acrylic resin containing a carboxyl group, and polyester-based resin containing a carboxyl group. These may be used independently or in a combination of two or more types.

In particular, the styrene-acrylic copolymer resin containing quaternary ammonium salt as its functional group is optimal from the perspective that the charged amount can be adjusted easily to a value within an intended range. In the foregoing case, as the preferable acrylic comonomer to be copolymerized with the foregoing styrene unit, (meta)acrylatealkyl esters such as methyl acrylate, ethyl acrylate, n-propyl acrylate, iso-propyl acrylate, n-butyl acrylate, iso-butyl acrylate, 2-ethylhexyl acrylate, methyl methacrylate, ethyl methacrylate, n-butyl methacrylate, and iso-butyl methacrylate can be used. Moreover, as the quaternary ammonium salt, a unit that is derived from dialkyl amino alkyl(meta)acrylate via the quaternation process is used. As the dialkyl amino alkyl(meta)acrylate to be derived, for example, di(lower alkyl)amino ethyl(meta)acrylates such as dimethyl amino ethyl (meta)acrylate, diethyl amino ethyl(meta)acrylate, dipropyl amino ethyl(meta)acrylate, and dibutyl amino ethyl(meta) acrylate; dimethyl methacryl amide, and dimethyl amino propyl methacryl amide are preferably used. Moreover, it is also possible to concurrently use hydroxy group-containing polymerizable monomers such as hydroxy ethyl(meta)acrylate, hydroxy propyl(meta)acrylate, 2-hydroxy butyl(meta)acrylate, and N-methylol (meta)acrylamide during the polymerization.

As the charge-controlling agent which shows negative charging characteristics, for example, an organic metal complex or a chelate compound is effective. As examples of the chelate compound, there is aluminum acetylacetonate, iron (II) acetylacetonate, and chromium 3,5-di-tert-butylsalicylate. As the organic metal complex, an acetylacetone metal complex or salicylic acid series metal complex or salt is preferable, and a salicylic acid series metal complex or a salicylic acid series metal salt is more preferable.

The content of the charge-controlling agent is preferably 0.5 to 15 parts by mass, more preferably 0.5 to 8 parts by mass, and even more preferably 0.5 to 7 parts by mass relative to 100 parts by mass of the binder resin. If the content of the charge-controlling agent is too small, there is a possibility that it will be difficult to stably charge the toner to a prescribed polarity. Thus, when performing image formation by developing an electrostatic latent image using toner in which it is difficult to stably charge the toner to a prescribed polarity, there is a possibility that the image concentration will decrease or it will be difficult to maintain the image concentration at a constant level. Moreover, the defective dispersion of the charge-controlling agent tends to occur, thereby causing so-called fogging or resulting in severe photoreceptor contamination. Meanwhile, if the additive amount of the charge-controlling agent is too great, this causes deterioration in the environment resistance, in particular charging failure and defective images under a high temperature, high humidity environment, and tends to cause defects such as photoreceptor contamination.

(Manufacturing Method)

Moreover, there is no particular limitation in the method of manufacturing the magnetic toner particles (toner mother particles). Specifically, for example, the pulverization method, polymerization method and the like may be considered. As the method of manufacturing the magnetic toner particles (toner mother particles) by the pulverization method, the following manufacturing process can be adopted.

Foremost, the respective components configuring the magnetic toner particles (toner mother particles) such as the binder resin and the magnetic powder are mixed with a mixer or the like. As the mixer, a known mixer may be used, and, for example, used may be a Henschel-type mixing machine such as a Henschel mixer, a super mixer, or a mechanomill, an angmill, a hybridization system, a cosmo system and the like. Among the above, the Henschel mixer can be preferably used.

Next, the obtained mixture is melted and kneaded with a kneading machine or the like. As the kneading machine, a known kneading machine can be used. For example, used may be an extruder such as a biaxial extruder, a triple roll mill, a laboratory mill and the like. Moreover, as the melting and kneading temperature, the temperature is preferably higher than the softening point of the binder resin and less than the thermal decomposition temperature of the binder resin.

Subsequently, the obtained molten kneaded material is cooled in a chilling machine to obtain a solid material, and the solid material is pulverized with a pulverizer or the like. As the chilling machine, a known chilling machine can be used; for example, used may be a drum flaker and the like. Moreover, as the pulverizer, a known pulverizer can be used. For example, used may be a pneumatic pulverizer such as a jet pulverizer (jet mill) that performs the pulverization using a supersonic jet air stream, a mechanical pulverizer such as a turbo mill, and an impact pulverizer such as a hammer mill, and the impact pulverizer is preferably used.

Finally, the obtained pulverized product is classified with a classifier or the like. As a result of this classification, it is possible to remove the excessively pulverized product and coarse powder, and obtain the intended toner mother particles. As the classifier, a known classifier can be used. For example, a pneumatic classifier or a centrifugal classifier such as a elbow jet classifier or a circular wind power classifier (rotary wind power classifier) can be used, and a pneumatic classifier is preferably used.

(External Addition)

The magnetic mono-component developer (magnetic toner) is obtained by externally adding the external additives described later to the magnetic toner particles (toner mother particles). In other words, the magnetic mono-component developer (magnetic toner) is obtained by performing external additive treatment to the magnetic toner particles with the external additives described later.

As the external additive treatment, any conventionally known external additive treatment can be used without limitation. Specifically, for example, in this treatment, external additives are added to the toner mother particles and agitated with an agitator or the like so as to adhere or fix the external additives to the surface of the toner mother particles.

As the external additive, there is no particular limitation so as long as it is formed from inorganic fine particles which have been subjected to surface treatment with a tin-containing compound and an antimony-containing compound. Specifically, for example, inorganic fine particles coated with tin oxide and antimony oxide can be used.

As the inorganic fine particles; that is as the inorganic fine particles to be subjected to surface treatment with a tin-containing compound and an antimony-containing compound, there is no particular limitation so as long as they can be used as the external additive of the toner. Specifically, for example, inorganic fine particles such as titanium oxide particles, silica particles, alumina particles, zinc oxide particles, magnetite particles, and zirconium oxide particles can be used. Among the above, the titanium oxide particles are preferably used. It is thereby possible to inhibit the occurrence of the development memory phenomenon. The reason for this is considered to be as follows. The titanium oxide particles function to perform the resistance adjustment of the magnetic toner, and it is considered that a relatively large amount of the tin-containing compound and the antimony-containing compound can be adhered by the surface treatment when the resistance thereof becomes high due to the hydrophobization treatment or the like. Consequently, it is considered that the B/A is able to more easily satisfy the foregoing relationship. Moreover, as the titanium oxide particles; for example, used may be anatase-type titanium oxide particles, rutile-type titanium oxide particles, and amorphous titanium oxide particles, and the anatase-type titanium oxide particles can be preferably used as the titanium oxide particles. Moreover, although there is no particular limitation in the particle diameter of the inorganic fine particles, preferably, the average primary particle diameter is roughly 0.1 to 0.3 μm. Moreover, when performing the surface treatment with the tin-containing compound and the antimony-containing compound, as the inorganic fine particles to be used, the inorganic fine particles can be used independently or in a combination of two or more types.

There is no particular limitation in the method of performing surface treatment to the inorganic fine particles with the tin-containing compound and the antimony-containing compound. Specifically, for example, a method of obtaining inorganic fine particles coated with tin oxide and antimony oxide can be used.

More specifically, for example, the following method can be used.

Foremost, a solution containing a water-soluble tin compound and a water-soluble antimony compound can be added to and mixed with a dispersion liquid in which the inorganic fine particles were dispersed in water. Here, by adjusting the pH, it is considered that the inorganic fine particles are subjected to surface treatment with the tin-containing compound and the antimony-containing compound. The solid content (cake) that was obtained by filtering and washing the dispersion liquid obtained from the foregoing mixture is calcinated. The calcinated solid content is thereafter pulverized. It is thereby possible to obtain inorganic fine particles coated with tin oxide and antimony oxide.

Note that there is no particular limitation in the respective conditions of the foregoing method, but specifically, for example, the following conditions can be adopted. As the water-soluble tin compound, for example, tin chloride can be used. Moreover, as the water-soluble antimony compound, antimony chloride can be used. Moreover, the concentration of the suspension is preferably around 20 to 300 g/l. Moreover, as the solution containing the water-soluble tin compound and the water-soluble antimony compound, for example, a solution in which the water-soluble tin compound and the water-soluble antimony compound were dissolved in 2N-dilute hydrochloric acid can be used. Moreover, the pH adjustment upon mixing the dispersion liquid in which the inorganic fine particles were dispersed in water and the solution containing the water-soluble tin compound and the water-soluble antimony compound is performed, for example, by a method of adding 10 mass percent of an alkali aqueous solution such as a sodium hydroxide aqueous solution to the compound liquid so that the pH of the compound liquid becomes roughly 2 to 7, preferably around 2 to 4, and more preferably around 3 to 4. The blending quantity of the water-soluble tin compound is preferably 6 to 15 parts by mass relative to 100 parts by mass of the inorganic fine particles. Moreover, the blending quantity of the water-soluble antimony compound is preferably 2 to 10 parts by mass relative to 100 parts by mass of the inorganic fine particles. Moreover, the blending ratio of the water-soluble tin compound and the water-soluble antimony compound is preferably 10:1 to 10:5 based on mass ratio. Although there is no particular limitation in the mixing time so as long as it is able to sufficiently perform the surface treatment, for example, the mixing time can be roughly 30 to 120 minutes. Moreover, although there is no particular limitation in the temperature of the compound liquid during the mixing, the temperature can be roughly 40 to 90° C. In addition, the calcination temperature can be roughly 300 to 800° C. Moreover, the calcination time can be roughly 30 to 120 minutes.

Moreover, the external additive may be subjected to hydrophobization treatment in order to be more tolerant to environmental influence. This hydrophobization treatment may be performed to the inorganic fine particles prior to performing the surface treatment, or be performed to the inorganic fine particles that were subjected to the surface treatment. There is no particular limitation in the hydrophobization treatment so as long as the treatment can be used as the hydrophobization treatment of an external additive. Specifically, for example, treatment using a titanate coupling agent can be used.

Moreover, as the external additive, in addition to the inorganic fine particles that were subjected to surface treatment with the tin-containing compound and the antimony-containing compound, other external additives can also be concurrently used. As other external additives, inorganic fine particles which were not subjected to the surface treatment can be used.

Moreover, the content of the external additive is preferably 0.2 to 3 parts by mass relative to 100 parts by mass the magnetic toner particles (toner mother particles).

As the agitator, a conventionally known agitator can be used without limitation. Specifically, for example, general agitators such as a turbine-type agitator, a Henschel mixer, and a super mixer can be used, and a Henschel mixer is preferably used.

EXAMPLES

The present disclosure is now explained in further detail based on the following Examples. Note that the present disclosure is not limited by the Examples in any way.

Example 1

(Magnetic Toner Particles)

Foremost, 100 parts by mass of polyester resin (alcohol component: bisphenol A propylene oxide additive, carboxylic acid component: terephthalic acid, Tg: 60° C., softening point: 150° C., gel fraction: 30%) as the binder resin, 76 parts by mass of magnetite particles (MTSB-905 manufactured by Toda Kogyo Corporation) as the magnetic powder, 3 parts by mass of Bontron No. 1 manufactured by Orient Chemical Industries Co., Ltd. as the charge-controlling agent, 8 parts by mass of styrene-acrylic resin (FCA196 manufactured by Fujikura Kasei Co., Ltd.) containing quaternary ammonium salt as the functional group as the charge-controlling agent, and 3 parts by mass of ester wax (WEP-5 manufactured by NOF Corporation) as the wax were mixed with a Henschel mixer (manufactured by Nippon Coke & Engineering Co., Ltd.). Subsequently, the obtained mixture was melted and kneaded under the condition of a cylinder setting temperature of 100° C. using a biaxial extruder (PCM-30 manufactured by Ikegai Corporation). The obtained molten kneaded material was cooled and thereafter coarsely pulverized with a feather mill. The coarsely pulverized molten kneaded material was finely pulverized with a turbo mill, and classified with a pneumatic classifier. Consequently, magnetic toner particles (toner mother particles) having a mean volume particle diameter of 8.0 μm were obtained. Note that the mean volume particle diameter of the magnetic toner particles was measured with a particle size analyzer (Multisizer 3 manufactured by Beckman Coulter K.K.).

(External Additive Treatment)

Foremost, 100 g of anatase-type titanium oxide particles was dispersed in water so that the concentration of the titanium oxide particles would be 100 g/l. The suspension obtained by the dispersal was heated to 70° C., a solution in which 10 g of tin chloride and 3 g of antimony chloride were dissolved in 50 ml of 2N-dilute hydrochloric acid was added to the heated suspension, and mixed for 60 minutes. Here, 10 mass percent of a sodium hydroxide aqueous solution was added to adjust the pH of the compound liquid to be 2 to 3. Subsequently, the solid content (cake) obtained by filtering and washing the obtained compound liquid was calcinated at 600° C. for 1 hour. The calcinated solid content was pulverized, and 3.0 mass percent of a titanate coupling agent was added to the pulverized product to perform coupling treatment. The particles obtained thereby were used as the inorganic fine particles P1. Note that the inorganic fine particles P1 are inorganic fine particles that were subjected to surface treatment using a tin-containing compound and an antimony-containing compound, and specifically are inorganic fine particles coated with tin oxide and antimony oxide.

Subsequently, as external additives, silica particles (REA200 manufactured by Nippon Aerosil Co., Ltd.) and the inorganic fine particles P1 were added to 2 kg of the obtained magnetic toner particles so that they respective become 0.5 mass percent and 1 mass percent, and this was mixed with a Henschel mixer (manufactured by Nippon Coke & Engineering Co., Ltd.) at a blade speed of 30 m/second for 3 minutes. Magnetic mono-component developer (magnetic toner: magnetic toner particles to which external additives were externally added) was thereby obtained.

(Image Forming Apparatus)

Subsequently, a monochrome printer (LS-4020DN manufactured by Kyocera Mita Corporation: image forming apparatus using a magnetic mono-component development system) was used and the magnetic mono-component developer was housed in the toner housing part of the image forming apparatus. The image forming apparatus obtained thereby was used and image formation was performed under a normal temperature, normal humidity environment at a temperature of 20 to 23° C. and relative humidity of 50 to 65% RH. Note that the monochrome printer includes a development roller in which the surface was subjected to alumite treatment, and an amorphous silicon photoreceptor as a photoreceptor drum.

Here, foremost, the ratio of antimony to iron was calculated from the peak derived from iron and the peak derived from antimony obtained by analyzing the toner to be housed in the toner housing part 354 with an X-ray fluorescence spectrometer (RIX2100 manufactured by Rigaku Corporation). Consequently, the ratio A of antimony to iron of the toner before being conveyed by the toner bearing member was 0.10%.

Subsequently, foremost, the image forming apparatus obtained as described above was used to perform image formation under a normal temperature, normal humidity environment at a temperature of 20 to 23° C. and relative humidity of 50 to 65% RH. Specifically, foremost, the power of the image forming apparatus was turned ON and the image forming apparatus was stabilized. An image of a coverage rate of 5% was thereafter consecutively printed on 10,000 sheets.

Subsequently, the ratio of antimony to iron was calculated from the peak derived from iron and the peak derived from antimony obtained by analyzing the toner that has been removed by the cleaning device 306 and recovered in the toner recovery bottle (waste toner box) with an X-ray fluorescence spectrometer (RIX2100 manufactured by Rigaku Corporation). The ratio B of antimony to iron of the toner that has been removed by the cleaning device was 0.20%.

Based on the above, the proportion of the ratio B of antimony to iron of the toner that has been removed by the cleaning device to the ratio A of antimony to iron of the toner before being conveyed by the toner bearing member; that is, B/A was 2.0.

Example 2

Other than using inorganic fine particles P2 which were manufactured as follows being used as a substitute for the inorganic fine particles P1, Example 2 is the same as Example 1.

Moreover, the inorganic fine particles P2 was manufactured in the same manner as the inorganic fine particles P1 other than adding a solution in which 10 g of tin chloride and 10 g of antimony chloride were dissolved in 50 ml of 2N-dilute hydrochloric acid to the suspension, and adjusting the pH of the compound liquid to 3 to 4 upon mixing the above.

Moreover, as a result of calculating the ratio A of antimony to iron of the toner before being conveyed by the toner bearing member with the same method as Example 1, the ratio A was 0.12%. Moreover, as a result of calculating the ratio B of antimony to iron of the toner removed by the cleaning device with the same method as Example 1, the ratio B was 0.37%. Based on the above, the proportion of the ratio B of antimony to iron of the toner that has been removed by the cleaning device to the ratio A of antimony to iron of the toner before being conveyed by the toner bearing member; that is, B/A was approximately 3.1.

Comparative Example 1

Other than using inorganic fine particles P3 which were manufactured as follows being used as a substitute for the inorganic fine particles P1, Comparative Example 1 is the same as Example 1.

Moreover, the inorganic fine particles P3 was manufactured in the same manner as the inorganic fine particles P1 other than adding a solution in which 10 g of tin chloride and 10 g of antimony chloride were dissolved in 50 ml of 2N-dilute hydrochloric acid to the suspension, and adjusting the pH of the compound liquid to 1.5 to 2.5 upon mixing the above.

Moreover, as a result of calculating the ratio A of antimony to iron of the toner before being conveyed by the toner bearing member with the same method as Example 1, the ratio A was 0.08%. Moreover, as a result of calculating the ratio B of antimony to iron of the toner removed by the cleaning device with the same method as Example 1, the ratio B was 0.09%. Based on the above, the proportion of the ratio B of antimony to iron of the toner that has been removed by the cleaning device to the ratio A of antimony to iron of the toner before being conveyed by the toner bearing member; that is, B/A was approximately 1.1.

Comparative Example 2

Other than using inorganic fine particles P4 which were manufactured as follows being used as a substitute for the inorganic fine particles P1, Comparative Example 2 is the same as Example 1.

Moreover, the inorganic fine particles P4 was manufactured in the same manner as the inorganic fine particles P1 other than adding a solution in which 5 g of tin chloride and 1.5 g of antimony chloride were dissolved in 50 ml of 2N-dilute hydrochloric acid to the suspension as a substitute for adding a solution in which 10 g of tin chloride and 10 g of antimony chloride were dissolved in 50 ml of 2N-dilute hydrochloric acid to the suspension.

Moreover, as a result of calculating the ratio A of antimony to iron of the toner before being conveyed by the toner bearing member with the same method as Example 1, the ratio A was 0.08%. Moreover, as a result of calculating the ratio B of antimony to iron of the toner removed by the cleaning device with the same method as Example 1, the ratio B was 0.12%. Based on the above, the proportion of the ratio B of antimony to iron of the toner that has been removed by the cleaning device to the ratio A of antimony to iron of the toner before being conveyed by the toner bearing member; that is, B/A was approximately 1.5.

(Development Memory)

The image forming apparatuses according to Examples 1 and 2 and Comparative Examples 1 and 2 were used to perform image formation under a normal temperature, normal humidity environment at a temperature of 20 to 23° C. and relative humidity of 50 to 65% RH. Specifically, foremost, the power of the image forming apparatuses were turned ON and the image forming apparatuses were stabilized. An image of a coverage rate of 5% was thereafter consecutively printed on 10,000 sheets.

The obtained images were visually confirmed, and evaluated as "excellent" if the occurrence of the development memory phenomenon could not be confirmed even with the image that was printed on the 10,000th sheet, evaluated as "good" if the occurrence of the development memory phenomenon could be confirmed with the image that was printed on the 10,000th sheet but the occurrence of the development memory phenomenon could not be confirmed up to the 5,000th sheet, and evaluated as "poor" if the occurrence of the development memory phenomenon could be confirmed with the image that was printed on the 5,000th sheet.

Consequently, the image forming apparatus according to Example 1 was evaluated as "excellent" and the image forming apparatus according to Example 2 was evaluated as "good". Meanwhile, the image forming apparatuses according to Comparative Example 1 and Comparative Example 2 were evaluated as "poor".

Thus, in the case of using an image forming apparatus in which B/A is 2 or more (Example 1 and Example 2), in comparison to the case of using an image forming apparatus in which B/A is less than 2 (Comparative Example 1 and Comparative Example 2), it was confirmed that the occurrence of the development memory phenomenon can be inhibited for a long period of time even if the image forming apparatus includes a development roller in which the surface was subjected to alumite treatment.

In addition, in the case of using an image forming apparatus in which B/A is 3 or more (Example 2), it was confirmed that the occurrence of the development memory phenomenon can be inhibited even when consecutively printing 10,000 sheets or more.

According to the present disclosure, it is possible to provide an image forming apparatus capable of inhibiting the occurrence of the development memory phenomenon and forming high quality images.

This application is based on Japanese Patent application No. 2010-211513 filed in Japan Patent Office on Sep. 22, 2010, the contents of which are hereby incorporated by reference.

Although the present disclosure has been fully described by way of example with reference to the accompanying drawings, it is to be understood that various changes and modifications will be apparent to those skilled in the art. Therefore, unless otherwise such changes and modifications depart from the scope of the present disclosure hereinafter defined, they should be construed as being included therein.

What is claimed is:

1. An image forming method, comprising:

charging, by a charging device, a peripheral surface of an image bearing member on which an electrostatic latent image is formed;

irradiating the peripheral surface of the image bearing member whose peripheral surface was charged, the irradiating being carried out with a light based on image information and forming an electrostatic latent image on the peripheral surface of the image bearing member by using an exposure device;

developing the electrostatic latent image formed on the image bearing member with the toner that has been conveyed by the toner bearing member, and forming a toner image on the image bearing member;

using a transfer device to transfer the toner image formed by the developing device to a recording medium; and using a cleaning device to remove the toner remaining on the image bearing member after the transfer, wherein a surface of the toner bearing member is subjected to alumite treatment, the toner is magnetic mono-component developer including magnetic toner particles containing at least binder resin and iron-containing magnetic powder, and an external additive to be externally added to the magnetic toner particles, the external additive is formed from inorganic fine particles which have been subjected to surface treatment with a tin-containing compound and an antimony-containing compound, the external additive is obtained by mixing a solution containing the tin-containing compound and the antimony-containing compound with a dispersion liquid obtained by dispersing the inorganic fine particles in water, a blending quantity of the tin-containing compound is 6 to 15 parts by mass relative to 100 parts by mass of the inorganic fine particles, a blending quantity of the antimony-containing compound is 2 to 10 parts by mass relative to 100 parts by mass of the inorganic fine particles, a mixed solution obtained by mixing the solution containing the tin-containing compound and the antimony-containing compound with the dispersion liquid has a pH of 2 to 4, and the ratio of antimony to iron of the toner that has been removed by the cleaning device is double or more the ratio of antimony to iron of the toner before being conveyed by the toner bearing member.

2. The image forming method according to claim 1, wherein the inorganic fine particles are titanium oxide particles.

3. The image forming method according to claim 1, wherein the image bearing member is an amorphous silicon photoreceptor.

* * * * *